United States Patent [19]

Palazzo

[11] Patent Number: 4,644,627

[45] Date of Patent: Feb. 24, 1987

[54] METHOD OF MAKING DOUBLE WALL STORAGE TANK FOR LIQUIDS

[76] Inventor: David T. Palazzo, P.O. Box 290676, Tampa, Fla. 33687

[21] Appl. No.: 818,258

[22] Filed: Jan. 13, 1986

Related U.S. Application Data

[63] Continuation-in-part of Ser. No. 775,140, Sep. 12, 1985.

[51] Int. Cl.[4] ..... B23P 17/00; B23P 19/04; B21D 39/00

[52] U.S. Cl. ..... 29/423; 29/455 R; 29/458; 138/149

[58] Field of Search ..... 29/455 R, 423, 458; 220/420, 445, 446, 448, 469, 1 B, 465, 855; 138/149, 148

[56] References Cited

U.S. PATENT DOCUMENTS

| | | | |
|---|---|---|---|
| 761,548 | 3/1904 | Sheaff | 220/445 |
| 3,000,433 | 9/1961 | Kemper | 29/455 R UX |
| 3,100,812 | 8/1963 | Mildner | 29/423 X |
| 3,279,029 | 10/1966 | Stern | 29/423 X |
| 3,299,417 | 1/1967 | Sibthorpe | 29/423 X |
| 3,848,765 | 11/1974 | Durkop | 220/445 |
| 3,921,273 | 11/1975 | Kondo et al. | 29/455 R X |
| 3,987,925 | 10/1976 | Sattelberg | 220/445 X |
| 4,104,783 | 8/1978 | Schultz et al. | 29/455 R X |
| 4,523,454 | 6/1985 | Sharp | 220/449 |
| 4,524,609 | 6/1985 | Sharp | 73/49.2 |
| 4,537,328 | 8/1985 | Keesee et al. | 220/445 |

*Primary Examiner*—Charlie T. Moon

*Attorney, Agent, or Firm*—Pettis & McDonald

[57] ABSTRACT

A double wall tank for the storage of liquids is manufactured from a rigid, cylindrical single wall inner tank by applying a primary spacing material to at least a portion of the exterior surface of the inner tank, applying over that inner tank exterior surface and primary spacing material a substantially rigid outer sheath of material, forming an opening through that sheath extending the full length of the sheath, introducing the secondary spacing material between the sheath and the inner tank exterior surface, and closing the sheath opening. This method provides a double wall storage tank in which at least a portion of the liquid-tight outer sheath is spaced from the inner tank.

17 Claims, 9 Drawing Figures

METHOD OF MAKING DOUBLE WALL STORAGE TANK FOR LIQUIDS

RELATED APPLICATION

This application is a continuation-in-part of application Ser. No. 775,140 filed Sept. 12, 1985, in the name of David T. Palazzo.

FIELD OF THE INVENTION

This invention relates to tanks for the storage of liquids, and more particularly to double wall tanks for underground storage of liquids.

BACKGROUND OF THE INVENTION

Tanks for the storage of liquids have been constructed in a variety of ways from a variety of materials. In one common application, the underground storage of hydrocarbons, such as gasoline and other petroleum products, the tanks have conventionally been fabricated out of steel or fiberglass, most commonly with a single rigid wall. In many applications this construction has proved reasonably satisfactory, with such tanks functioning properly for many years before requiring repair or replacement. However, the increasing age of many of the tanks currently in place is beginning to present serious environmental dangers. Many of the older steel tanks buried underground have rusted and are beginning to leak, thus releasing the petroleum materials into the ground where they may seep into and pollute underground water supplies. While rustproof, some fiberglass tanks have also exhibited leakage, causing the same problems.

One of the primary problems with leaking storage tanks has been the difficulty or inability to ascertain when or if such leaks are occurring from a given tank. Because the excavation and removal of such a storage tank, which may contain thousands of gallons of fuel, is an expensive and difficult undertaking, such an operation is difficult to justify unless there is some evidence of actual leakage.

Because of the increasing potential danger of leaking storage tanks, particularly in communities that utilize ground water for public consumption, many municipalities have implemented or plan to implement ordinances requiring the use of double wall storage tanks underground and requiring replacement of existing single wall tanks. While the installation of a conventional double wall tank in a new facility entails no great difficulty and a generally manageable increase in cost over a single wall tank, the burden of complying with such ordinances by replacing existing sound, single wall tanks with double wall tanks can be heavy. This burden has prompted the search for methods of fabricating relatively inexpensive double wall tanks. This burden has also given impetus to the search for a method of remanufacturing existing single wall tanks into a double wall assembly with means for detecting the presence of any leaks into the space between the two walls.

SUMMARY OF THE INVENTION

In view of the foregoing, it is the object of the present invention to provide an economical method of manufacturing a double wall storage tank from rigid single wall tank. It is a further object of the invention to provide such a method in which at least a portion of the outer wall or sheath of the tank is spaced from the inner tank.

To achieve these and other objects that will become readily apparent to those skilled in the art, this invention provides a method of manufacturing from a rigid single wall cylindrical inner tank a rigid double wall tank for the storage of liquids. This method includes the steps of applying to at least a portion of the exterior surface of the rigid inner tank a primary spacing material having a predetermined thickness, applying over and closely adjacent both these cylindrical sidewall portions of the inner tank exterior surface and the primary spacing material a substantially rigid sheath of material that is substantially liquid tight, so that the sheath defines a generally cylindrical member, forming an opening through the sheath, such opening extending the full length of the sheath cylindrical member, introducing between the sheath and the inner tank exterior surface secondary spacing material to space at least a substantial portion of the inner surface of the sheath from the inner tank exterior surface, closing the sheath opening and applying to the axial extremities of the sheath cylindrical member substantially rigid and liquid tight sheath end portions overlying the inner tank end portion and extending generally transverse to the sheath cylindrical portion, this forming the sheath enclosing the inner tank and defining a double wall tank.

In a preferred embodiment of the invention the secondary spacing material may comprise a rod-like material extending around the circumference of the tank in a generally helical pattern, and the outer sheath may be formed of a resin impregnated glass fiber material supported by the secondary spacing material away from the inner tank.

BRIEF DESCRIPTION OF THE DRAWINGS

Particularly preferred embodiments of the method and apparatus of this invention will be described in detail below in connection with the drawings in which.

DESCRIPTION OF PREFERRED EMBODIMENTS

Figure 1:
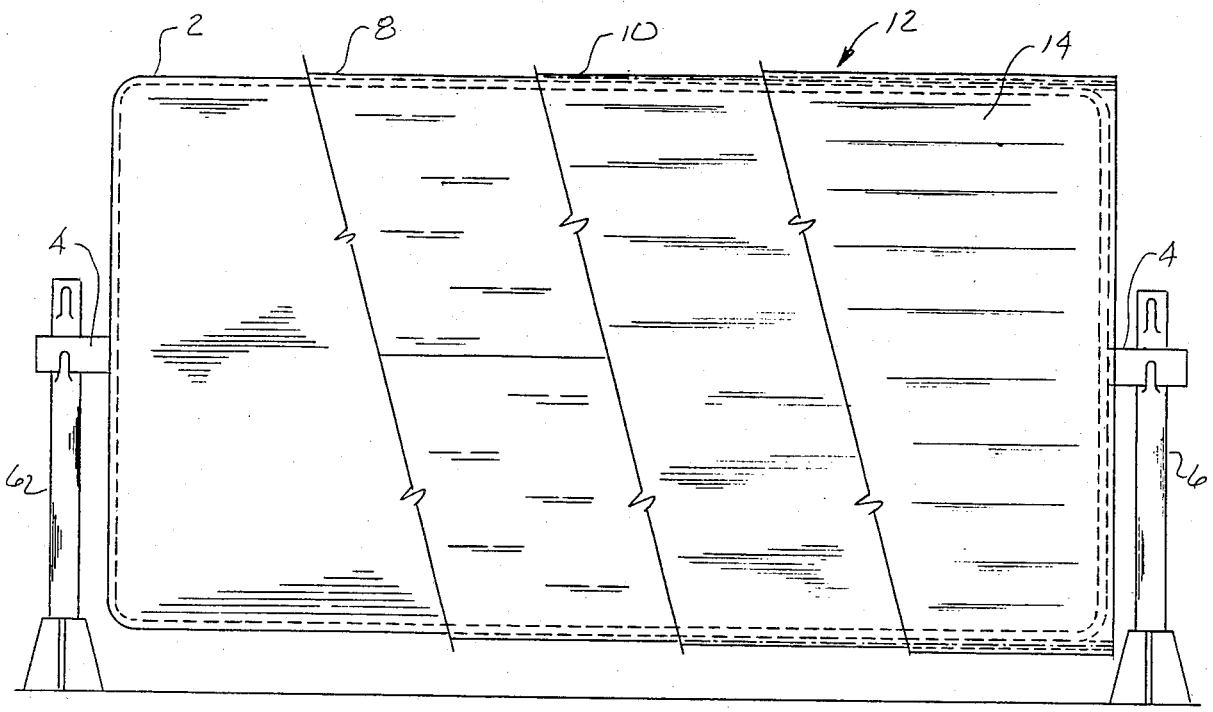
FIG. 1 is a side elevational, partially in section, of a tank according to the present invention, illustrating the initial steps in the fabrication process.
Figure 2:
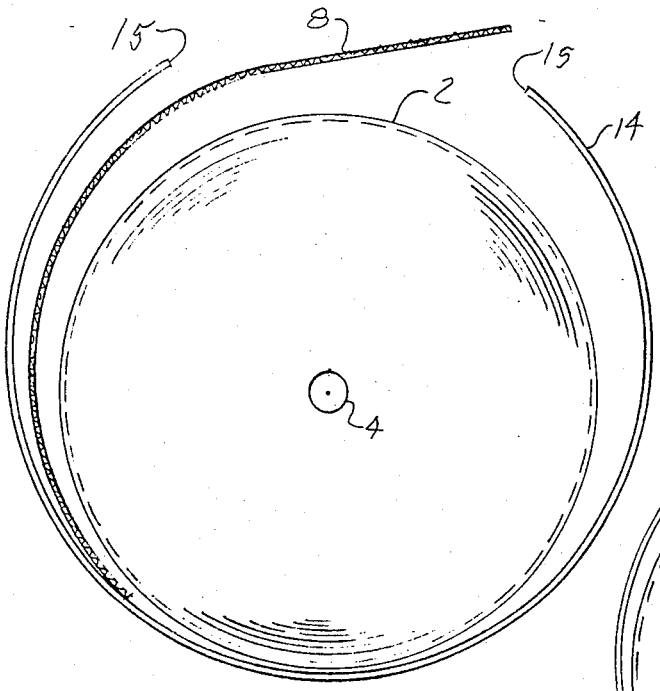
FIG. 2 is an end sectional view of one preferred embodiment of the tank of this invention illustrating the use of the primary spacing material and the step of opening the sheath.
Figure 3:
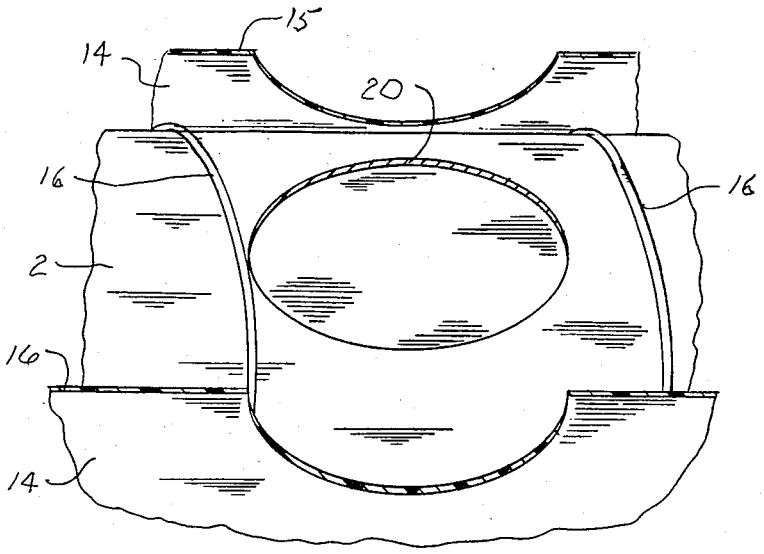
FIG. 3 is a fragmentary upper perspective view of the tank of FIG. 1, illustrating both the application of the secondary spacing material and the forming of an aperture through the tank wall and outer sheath.
Figure 4:
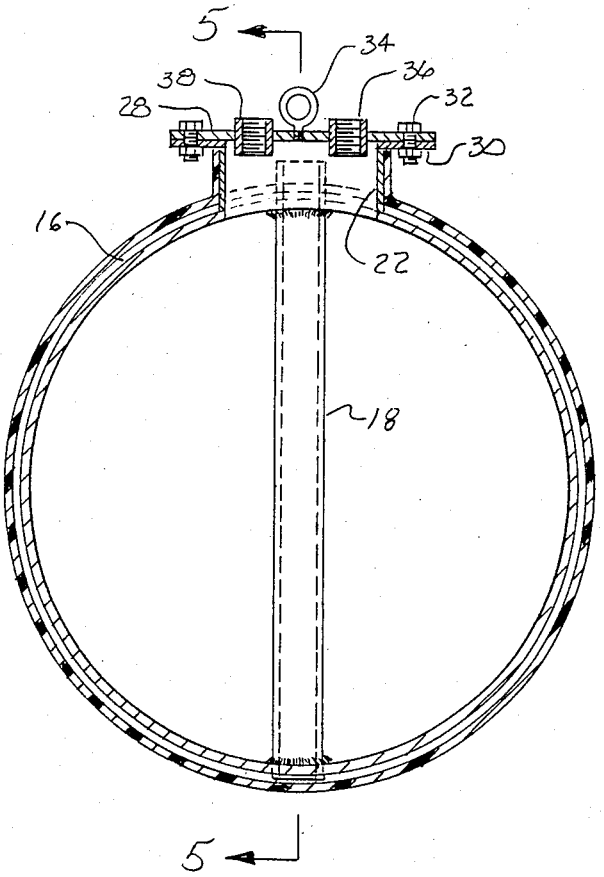
FIG. 4 is an end sectional view of a completed tank according to FIG. 1.
Figure 5:
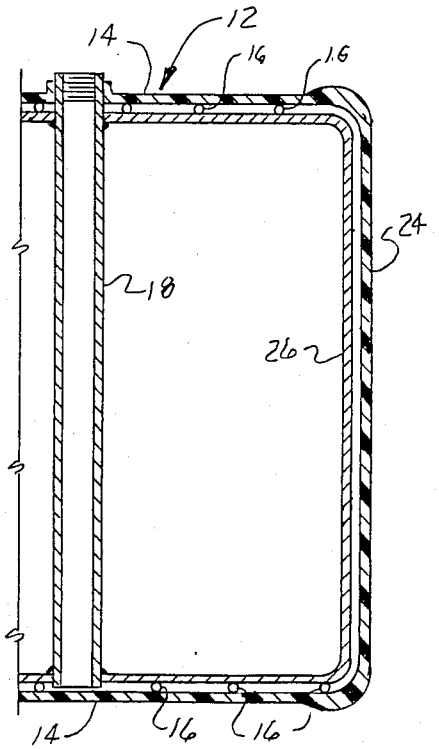
FIG. 5 is a partial side sectional view taken along line 5—5 of FIG. 4.
Figure 6:
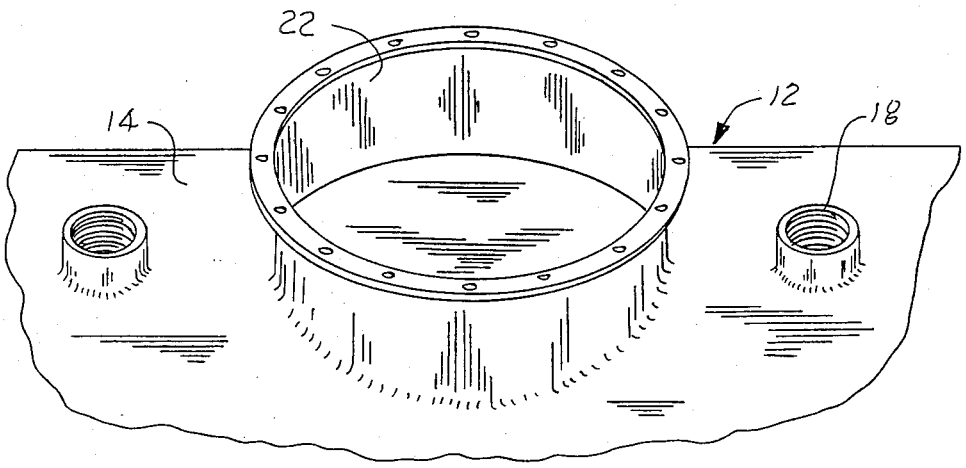
FIG. 6 is fragmentary upper perspective view of the apparatus of FIGS. 5 and 6, illustrating the completed installation of a port and of the plumbing connections.

A preferred embodiment of the apparatus of this invention is illustrated in FIGS. 4, 5 and 6, with certain intermediate steps in the fabrication thereof being illustrated in FIGS. 1, 2 and 3. FIG. 1 is a side elevational view, partially in section, illustrating the initial steps for making the tank of this embodiment by the application of various materials to the inner storage tank 2.

While various forms and shapes of tanks may be utilized in practicing this invention, the most common shape utilized for underground storage is that of a cylinder, generally a right circular cylinder, having closed end portions. For simplicity of illustration this configuration of tank is utilized for illustrating preferred embodiments of the invention. Also, while virtually any construction of a rigid inner tank, whether of metal or fiber glass or other materials, may be utilized in practicing this invention, one preferred and readily available type of structure is a tank formed of welded steel, having an appropriate corrosion resisting coating on the liquid contacting surfaces. For purposes of illustration, such a steel tank will be described. It is also to be understood that the tank to be used may be a newly fabricated tank, which may but generally does not have any manhole opening cut in it. Alternatively, the tank may be a previously used tank removed from its prior underground installation and cleaned for reuse with this invention. With such a reused tank it is generally convenient, although not necessary, for this invention that any manhole openings or plumbing attachments be removed and covered prior to the fabrication process.

To prepare an uncoated or previously used steel tank 2, it is desirable that the exterior surface be conventionally sandblasted and coated with a rust inhibiting material, such as paint. Then, to simplify subsequent steps, it is preferred but not required that a spindle 4 be attached, such as by welding, to the center of each tank head or end portion, collinear with the axis of the tank. As shown in FIG. 1, the spindles 4 and thus the inner tank 2 may then be supported off the ground on conventional uprights 6. This provides for rotation of the tank 2 about its axis for purposes to be set forth below.

In the next step of the present invention, a primary spacing material 8 is applied to at least a portion of the cylindrical sidewall portions of the exterior surface of inner tank 2 and may be applied to the entire exterior surface of the cylindrical wall portions of the tank 2. This spacing material 8 may comprise any type of material having a slight thickness, desirably on the order of one-quarter inch or more, and may suitably be common corrugated cardboard. Conveniently, large sheets of such primary spacing material may be placed over substantially the entire cylindrical sidewall surface of the inner tank 2, extending substantially the full length of the cylindrical sidewall portions of that tank, with adjacent edges of the spacing material 8 being held together, such as by taping. Strong joints between adjacent edges of the primary spacing material 8 are not necessary, because the purpose is merely to hold this material in place temporarily while the exterior sheath, described below, is being applied.

The exterior sheath of the tank of this invention may be fabricated in a number of different ways. One advantageous method comprises wrapping over the exterior cylindrical walls of the tank and over the primary spacing material 8 with a web of imperforate material, such as a stretched film 10 of a synthetic resin, such as polyethylene or the like. Conveniently, this web 10 may be stretched over the inner tank exterior surfaces and this primary spacing material 8 as the tank 2 is rotated on its spindles 4. This application of stretched film 10 over the spacing material 8 prevents subsequent material used in forming the outer sheath from contacting those portions of the inner tank 2 and of the primary spacing material 8 over which the outer sheath is applied. Various other materials could likewise be substituted in place of the stretched film to support the subsequent layers of the sheath. Additionally, with appropriate selection of materials used in fabricating the sheath, it may be possible to dispense with the use of this stretched film 10.

In this embodiment preferably the entire rigid outer sheath 12, and particularly the cylindrical sidewall portions 14 thereof, are formed by bonding resin impregnated glass fiber mats to the film 10 in a conventional manner. It has been found convenient to lay sections of such glass fiber matting over the film-wrapped inner tank and then apply suitable and well known resins to that matting, although matting that is impregnated with resins could be used with equal facility. While the thickness of the outer sheath 12 may vary according to the severity of the conditions anticipated, it should be of sufficient thickness to provide a substantially rigid sheath. It has been found that one quarter inch thickness of the cured, resin-impregnated glass fiber matting generally provides sufficient strength and rigidity for the sheath 12.

Upon curing of the resin mixed with the glass fiber matting applied over the film 10, primary spacing material 8 and cylindrical sidewalls of the tank 2, this cured material defines a sheath portion in the form of a substantially cylindrical member 14. In this preferred embodiment the next step is the forming of an opening through that sheath, with the opening extending the full length of the sheath cylindrical member 14. This opening may be formed by slitting, suitably by means of a circular saw, along the entire length of the cylindrical member 14. With this opening or slit being formed through the sidewalls of the cylindrical member 14 and over the primary spacing material 8, it is desirable to set the cutting depth of the saw blade sufficient to cut entirely through the resin impregnated glass fiber 14 and partially into the primary spacing material 8, while remaining free from engagement with the cylindrical sidewalls of the inner tank 2. This constitutes one primary function of the primary spacing material 8.

When the opening, or slit, whose edges are indicated by the reference numeral 15 in FIG. 2, has been made, the cylindrical sidewall 14 of the outer sheath may then be pulled open and away from engagement with the primary spacing material 8 and tank 2 underlying it. At that time the primary spacing material 8 may, if desired, be removed from its position surrounding at least a portion of the sidewalls of that inner tank 2. Such removal is facilitated by the use of the film 10 interposed between the resin of the sidewall portion 14 and the primary spacing material 8.

With the cylindrical sidewall 14 of the sheath preferably held open and spaced away from the inner tank 2, and preferably but not necessarily with the primary spacing material 8 removed from the tank 2, a secondary spacing material 16 may then be applied. This secondary spacing material 16 may desirably be formed of a welt or flexible rod-like member of a non-corroding material, such as polyethylene. The thickness of this secondary spacing material 16 is not critical but may desirably be on the order of one-quarter inch, or generally comparable to the thickness of the primary spacing material 8. Where the secondary spacing 16 is such a welt, one end may be attached, as by an adhesive, to the cylindrical sidewall of the tank 2, preferably adjacent one end thereof. Then the secondary spacing material 16 may conveniently be applied to the remainder of the tank by rotating the tank on the spindles 4 while laying the material 16 onto the exterior of the tank preferably in a spaced, helical pattern, such as shown in fragmentary view of FIG. 3. When this secondary spacing material 16 has been placed along a substantial portion, and preferably the entire length, of the exterior surface of the inner tank 2 in such an open pattern, the second end of that material 16 may then be affixed to the cylindrical sidewall of the inner tank 2 adjacent the second end thereof.

Preferably while the cylindrical member 14 remains spread open, any apertures, such as manholes or plumbing fixtures, necessary to be provided through the sidewall of the inner tank 2 are cut by appropriate means to provide openings such as illustrated in FIG. 3. Preferably, any such aperture, the edge of which is indicated in FIG. 3 by reference number 20, and the secondary spacing material 16 are so positioned to have the aperture through a portion of the inner tank sidewall that is free of such secondary spacing material 16, as well as of any primary spacing material 8. Also as shown in FIG. 3, corresponding apertures are cut through the cylindrical member 14, suitably half on each side of the opening along the length of that cylindrical member 14.

After any such apertures have been formed, a hollow cylindrical member 22, preferably having a shape and size corresponding generally to the shape and size of the aperture 20, is sealingly joined to the cylindrical sidewall of the tank 2 suitably by welding the joint adjacent the periphery of the aperture to the inner tank 2. This then provides a manhole. Additional fittings such as for tube 18, described below, may also be attached, suitably by welding, within other apertures formed in the tank 2 sidewall. When all of these fittings have been affixed to the tank, the edges of the sheath cylindrical member 14 that had been spread apart during these steps may then brought back together, with that cylindrical member 14 then again forming a generally cylindrical sheath about the sidewall of the inner tank 2. Where the primary spacing material 8 has been removed from its inner position between the sheath member 14 and the inner tank 2, the only item spacing that member 14 from engagement with the sidewall of inner tank 2 is the secondary spacing material 16. If that secondary spacing material 16 is substantially equal in thickness to the primary spacing material 8 that had been removed, the edges 15 of the sheath member 14 may be brought back together and the opening in such sheath then closed, suitably by application of appropriate resin with or without reinforcing glass fiber cloth. The portions of the sheath cylindrical member 14 adjacent the fittings, such as the manhole cylindrical member 22, may then be bonded thereto with the appropriate resin, thus yielding a finished structure generally as shown in the fragmentary perspective view of FIG. 6.

To form the end portions 24 of the sheath 12, resin impregnated glass fiber mat may simply be laid and wrapped around the tank end portions, forming a continuous structure with the cylindrical sidewalls 14, as shown in FIG. 5. When applying these end portions 24, a spacing material to hold those portions 24 from the axial end portions 26 of the tank 2 may be provided or omitted as a matter of choice. If such spacing material is omitted, as illustrated in FIG. 5, it is preferable to coat the end portions 26 of the tank 2 with a release agent to prevent the fiber glass resin from bonding to these end portions 26 of the tank. This continuous application of the glass fiber material may be effected with the tank still supported by the spindles 4, or with those spindles cut off. If the spindles are retained, they may be cut off at a later time and a patch placed over the hole left by the spindle. Alternatively, the end portions 24 of the sheath 12 may be fabricated separately from the cylindrical sidewall portion 14, as by forming over a male mold plug. When this separate fabrication technique is used, those end portions 24 may then be bonded to the sidewall portions 14, and extending generally transverse thereto, thus providing substantially the same final result as in the continuous lay-up method.

As shown in FIG. 4, a tube 18 may extend through apertures through two portions of the cylindrical sidewalls of the tank 2. These sidewalls portions may preferably be a first, or top portion, alongside the manhole cylinder 22 and a second or bottom sidewall portion generally diametrically opposed to the first. The lowermost end of the tube 18 preferably extends between an upper point exterior to the sheath 12 and a point adjacent the inner surface of the sheath bottom or second sidewall portion, as shown in FIGS. 4 and 5. As with the manhole cylindrical member 22, the joints between the tube 18 and both the outer sheath sidewall 14 and the sidewalls of the inner tank 2 are sealed liquidtight in conventional manners. The opening of this tube 18 between the sidewall second portion of the inner tank 2 and the inner surface of the sidewall 14 of the sheath 12 thus permits pressure testing of the sheath and tank and also the detection and extraction of any liquid present in that space between the respective sidewalls.

Figure 7:
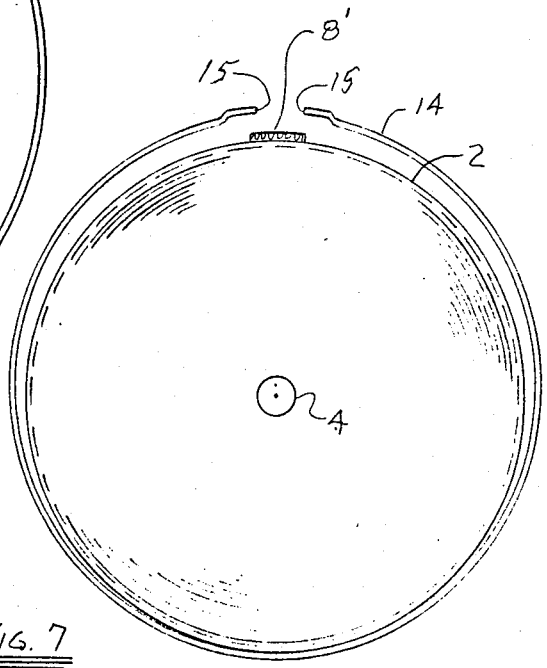
FIG. 7 is an end sectional view of a tank according to a second preferred embodiment of this invention utilizing a narrow strip of primary spacing material.
Figure 8:
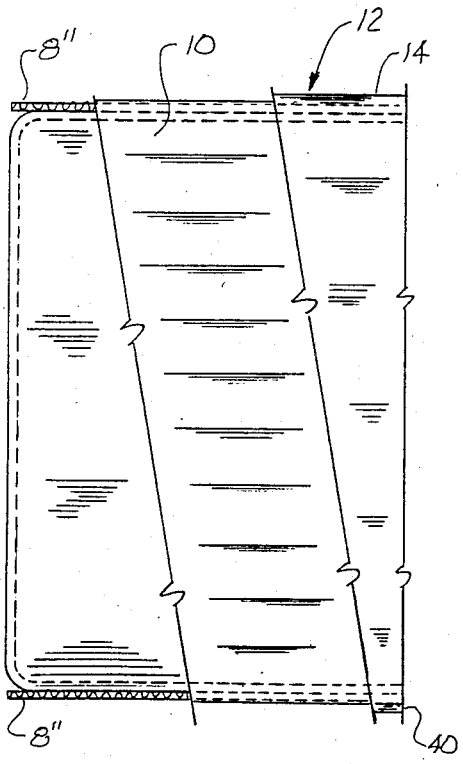
FIG. 8 is a fragmentary side elevation, partially in section of a tank formed according to a third embodiment utilizing two strips of primary spacing material.
Figure 9:
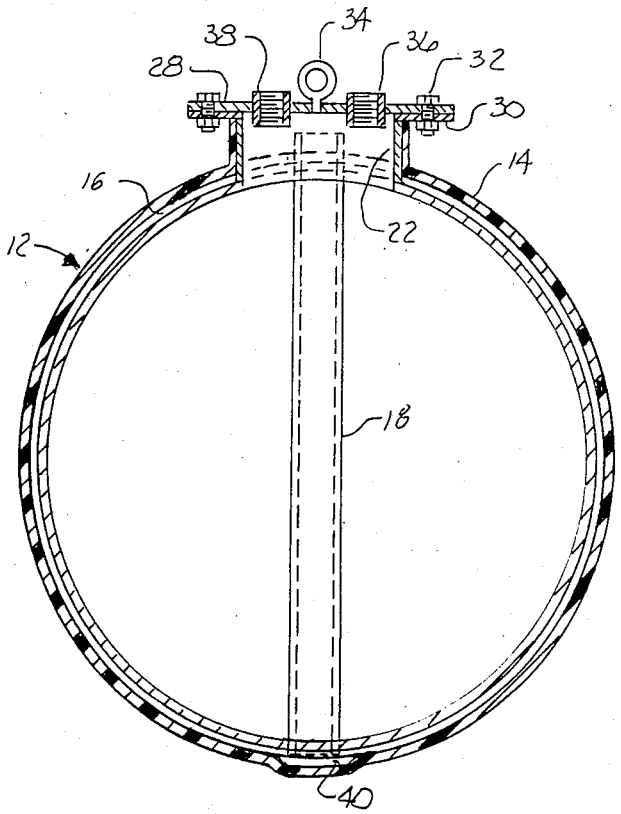
FIG. 9 is an end sectional view of the completed tank according to the embodiment of FIG. 8.

Alternative embodiments of the tank and fabrication method of this invention are illustrated in FIGS. 7, 8 and 9. The embodiment of FIG. 7 is substantially the same as that of the proceeding description, except that the primary spacing material 8' comprises a strip of the primary spacing material extending substantially the entire length of the cylindrical sidewall of the tank. This trip 8' may comprise corrugated cardboard or other material similar to that of FIG. 2 and may comprise a strip whose width in the direction circumferential to the inner tank 2 is small relative to the length thereof. While it is not necessary that this strip run parallel to the axis of the cylindrical tank, such an arrangement is preferable and simplifies the fabrication. With this embodiment the strip 8' need only be wide enough to provide the necessary protection to the surface of inner tank 2 from the saw blade used to cut through the cylindrical member sidewall 14.

The final appearance of the tank fabricated according to the embodiment of FIG. 7 would be substantially the same as with the embodiment described above. The only noticeable difference might be a slight bulge where the primary spacing material 8' was located and a slight gap to be filled between the edges 16 of the opening cut in that member 14 caused by the spreading of that member when the secondary spacing material 16 is applied completely about the inner tank 2.

The embodiments of FIGS. 8 and 9 are similar to that of FIG. 7, but incorporate the use of two such strips of primary spacing material 8''. These strips 8'' preferably are positioned substantially diametrically opposite one another upon the inner tank and the opening or slit 15 in the sheath 14 is formed, as with the embodiment of FIG. 7 over one such strip 8″. After such slitting, both such strips 8″ preferably are removed, with the area occupied by the lower said strip 8″ then forming a slight depression or sump 28 along the bottom of the outer sheath 12. This sump 28 further facilitates the collection of liquid accumulating between the exterior surface of the inner tank 2 and the inner surface of the outer sheath 12.

A suitable cover plate 28 may be provided for the cylindrical member 22 as shown in FIG. 4. This cover plate may conveniently be secured to the upper flange 30 of that cylindrical member 22 by conventional means, such as plurality of bolts 32 extending through the cove plate 28 and the flange 24. In this cover plate 28 may be provided such items as a lifting ring 34 and conventional fittings 36 and 38 to provide for insertion of appropriate plumbing to facilitate introduction and withdrawal of liquids to be stored within the completed tank.

Upon completion of the manufacturing steps set forth above, both the inner tank 2 and its sheath 12 may have pressure applied to them, as by compressed air. With the apparatus illustrated, the application of pressure through the tube 18 will permit not only the testing of the sheath 12 for any leakage but also the testing of the tank 2 to ascertain if there is any leakage of that pressurized air from the space between the sheath 12 and the inner tank 2 into that inner tank 2. Such application of pressure will also serve to pop free any portion of the end caps 24 that may have stuck to the release agent applied to the end portions 26 of the inner tank 2, in order to permit passage of liquids along the exterior surface of the end portions 26 of that inner tank 2.

By the foregoing construction there is thus provided a double wall tank that can be manufactured economically from a conventional steel wall tank and even from a used tank that had previously been removed from underground storage use. This structure provides an exterior sheath, which may be formed from a material that is liquid-tight and free of any tendency to rust or corrode and which is spaced from the inner tank to permit the collection within that space and thus detection of any liquids leaking into that space, either from the tank or from sources exterior to the sheath. Thus may be determined the existence of any leakage of either the tank or the sheath by simply detecting the presence and nature of any liquid present in that space. By the use of a relatively thick and rigid outer sheath, the strength of that sheath is enhanced over similar structures that may use a flexible outer covering. Furthermore, such a rigid external sheath permits testing of the integrity of the sheath and tank at substantial pressures, which could not be done with a flexible covering without danger of rupture.

While the foregoing describes in detail several preferred embodiments of the tank of this invention, it is to be understood that such description is illustrative only of the principles of the invention and is not to be considered limitative thereof. Because numerous variations and modifications of both the method of manufacture and the resulting tank will readily occur to those skilled in the art, the scope of this invention is to be limited solely by the claims appended hereto.

What is claimed is:

1. A method of manufacturing a rigid double wall tank for storage of liquids from a rigid, single wall, cylindrical inner tank the exterior surface of which has cylindrical sidewall portions of predetermined axial length and end portions extending generally transverse to said sidewall portions, said method comprising the steps of applying to at least a portion of the cylindrical sidewall portions of the exterior surface of said rigid inner tank primary spacing material having a predetermined thickness;

applying over and closely adjacent both said cylindrical sidewall portions of said inner tank exterior surface and said primary spacing material a substantially rigid sheath of a material that is substantially liquid-tight, whereby said sheath defines a substantially cylindrical member;

forming an opening through said sheath, said opening extending the full length of said sheath cylindrical member;

introducing between said sheath and said inner tank exterior surface secondary spacing material to space at least a substantial portion of the inner surface of said sheath from said inner tank exterior surface;

closing said sheath opening; and applying to the axial extremities of said sheath cylindrical member substantially rigid and liquid-tight sheath end portions overlying said inner tank end portions and extending generally transverse to said sheath cylindrical portions, whereby is formed a sheath enclosing said inner tank, thus defining a double wall tank.

2. The method of claim 1 wherein said primary spacing material is removably applied to said internal tank exterior surface and wherein said method further comprises the step of removing said primary spacing material from between said sheath and said internal tank exterior surface before introducing said secondary spacing material.

3. The method of claim 2 wherein said sheath opening is formed in the portion of said sheath overlying said primary spacing material.

4. The method of claim 1 wherein said primary spacing material extends substantially the full length of said inner tank cylindrical sidewall portions.

5. The method of claim 4 wherein said primary spacing material comprises a strip whose width in the direction circumferential to said inner tank is small relative to the length of said primary spacing material.

6. The method of claim 5 wherein said primary spacing material comprises two said strips positioned substantially diametrically opposite one another upon said inner tank and wherein said sheath opening is formed in the portion of said sheath overlying one of said strips.

7. The method of claim 1 wherein said secondary spacing material comprises an extended rod-like material extending generally around the circumference of said inner tank.

8. The method of claim 7 wherein said secondary spacing material is positioned around said inner tank cylindrical sidewall portions in a generally helical pattern extending from a point adjacent one end of said inner tank sidewall portion to a point adjacent to the other end of said sidewall portion.

9. The method of claim 1 further comprising the step of forming an aperture through said sheath and said sidewall of said inner tank in a portion of said inner tank sidewall that is free of both said primary spacing material and said secondary spacing material, whereby said aperture provides access to the interior of the inner tank.

10. The method of claim 9 further comprising the steps of sealingly joining to said inner tank sidewall adjacent the periphery of said aperture therethrough a hollow cylindrical member having a shape and size of said inner tank aperture, and sealingly joining said sheath to the exterior of said hollow cylindrical member.

11. The method of claim 10 wherein said aperture through said sheath is located intersecting a portion of said opening extending the full length of said sheath cylinder.

12. The method of claim 11 wherein said aperture through said sheath and said inner tank is formed prior to the step of closing said sheath opening.

13. The method of claim 1 further comprising the steps of providing apertures through a first portion of said cylindrical sidewalls of said sheath and said inner tank and through a second, generally opposed portion of said inner tank sidewall, the insertion of tube means through said apertures and extending between a point exterior to said sheath and said inner tank and a point adjacent the inner surface of said sheath and proximal said second portion of said inner tank sidewall, and the forming of liquid-tight joints between said tube means and the peripheries of said apertures, whereby any liquid within the space between the inner tank and the sheath may be contacted by and withdrawn through the tube means.

14. The method of claim 1 wherein said sheath comprises at least one layer of fibrous material coated with a curable resin which, upon curing, provides a coating that is resistant to the passage of water or hydrocarbon liquids.

15. The method of claim 14 wherein said fibrous material comprises a mat of glass fibers.

16. The method of claim 14 wherein said application of said sheath comprises applying an imperforate web over said primary spacing material and said inner tank sidewall portions prior to application of said fibrous material and resin.

17. The method of claim 1 wherein said sheath end portions are formed separate from said sheath cylindrical member and are then joined to the axial extremities of said sheath cylinder in a liquid-tight manner.

* * * * *